US006211450B1

(12) United States Patent
Ishida

(10) Patent No.: US 6,211,450 B1
(45) **Date of Patent: *Apr. 3, 2001**

(54) ANTIBACTERIAL KEYBOARD

(75) Inventor: Muneo Ishida, Shizuoka-ken (JP)

(73) Assignee: Kabushiki Kaisha Kawai Gakki Seisakusho, Hamamatsu (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/860,169

(22) PCT Filed: Sep. 25, 1996

(86) PCT No.: PCT/JP96/02762

§ 371 Date: Jun. 16, 1997

§ 102(e) Date: Jun. 16, 1997

(87) PCT Pub. No.: WO97/15042

PCT Pub. Date: Apr. 24, 1997

(30) Foreign Application Priority Data

Oct. 19, 1995 (JP) ..... 7-296059

(51) Int. Cl.[7] ..... G10C 3/12
(52) U.S. Cl. ..... 84/423 R; 424/405
(58) Field of Search ..... 84/423 R; 424/404, 424/405; 523/168

(56) References Cited

U.S. PATENT DOCUMENTS

| | | | | |
|---|---|---|---|---|
| 3,857,934 | * | 12/1974 | Bernstein et al. | 424/30 |
| 4,008,351 | * | 2/1977 | Inoue et al. | 428/411 |
| 4,840,104 | * | 6/1989 | Ishida et al. | 84/437 |
| 5,324,525 | * | 6/1994 | Sakuma et al. | 424/602 |
| 5,559,297 | * | 9/1996 | Yoshikawa et al. | 84/433 |

FOREIGN PATENT DOCUMENTS

| | | |
|---|---|---|
| 61-196294 | 12/1986 | (JP) . |
| 1-100109 | 4/1989 | (JP) . |
| 4-264003 | 9/1992 | (JP) . |
| 5-97619 | 4/1993 | (JP) . |
| 5-339509 | 12/1993 | (JP) . |
| 7-44156 | 2/1995 | (JP) . |

* cited by examiner

*Primary Examiner*—Robert E. Nappi
*Assistant Examiner*—Kim Lockett
(74) *Attorney, Agent, or Firm*—Evenson, McKeown, Edwards & Lenahan, P.L.L.C.

(57) ABSTRACT

The present invention relates to an antibacterial key for use in a keyboard of a musical instrument. The antibacterial key comprises a key stick and a key cover adhered on the upper surface of the key stick through an adhesive layer. The adhesive layer comprises an adhesive containing a volatile antibacterial agent and can readily add an antibacterial function to the key with an antibacterial effect of the antibacterial agent, which volatilizes from the adhesive layer, at a low cost irrespective of a material or a manufacturing method of the key cover.

18 Claims, 2 Drawing Sheets

ANTIBACTERIAL KEYBOARD

FIELD OF THE INVENTION

The present invention relates to antibacterial keys for musical instruments having a keyboard to which antibacterial treatment is performed for preventing the proliferation of bacteria thereon.

BACKGROUND OF THE INVENTION

An antibacterial bacterial key is disclosed in Japanese Patent Application NO. 7-107373. An antibacterial function is added to a keyboard because a musical instrument having a keyboard is often used commonly by a large number of persons, particularly, in school, so that there is a fear that bacteria attached on fingers of a person be transferred to fingers of another person who next plays the musical instrument through the keyboard. An antibacterial key comprises a key stick and a key cover adhered to the upper surface of the key stick. The key cover is made of synthetic resin containing an antibacterial agent. Specifically, calcium phosphate including metal silver is used as the antibacterial agent. A predetermined amount of the antibacterial agent is added to a palette of acrylic resin, uniformly distributed therein, and molded by injection molding. According to this structure, the antibacterial effect of the antibacterial agent included in the key cover prevents bacteria from proliferating on the key, thus maintaining the cleanliness on the key as well as preventing discoloration of the key.

However, with the conventional antibacterial key, since the key cover is formed by injection molding acrylic resin containing an antibacterial agent, the antibacterial agent acts as an impurity during the injection molding, thus disadvantageously causing difficulties in producing a uniform key cover, for example, moire patterns may appear on the surface of a molded key cover. Therefore, the yield of the molds is reduced, and this causes the cost to increase.

It is therefore an object of the present invention to provide an antibacterial key which is capable of readily adding an antibacterial function at a low cost irrespective of a material or a manufacturing method of a key cover.

SUMMARY OF THE INVENTION

According to the present invention, there is provided an antibacterial key which comprises a key stick and a key cover adhered to the upper surface of the key stick with an adhesive layer, wherein the adhesive layer includes an adhesive containing a volatile antibacterial agent.

According to this antibacterial key, the adhesive layer exposes on the side surfaces of the key between the key stick and the key cover, so that the antibacterial agent included in the adhesive layer always volatilizes from the side surfaces to the outside to surround the key. Thus, the action of the antibacterial agent prevents bacteria from proliferating on the key, resulting in maintaining the cleanliness of the key as well as preventing discoloration due to the proliferation of bacteria.

In this way, the antibacterial key of the present invention provides an antibacterial effect by the antibacterial agent volatilizing from the adhesive, so that an antibacterial function can be added irrespective of a material or a manufacturing method of the key cover. Particularly, when a key cover is molded by injection molding acrylic resin, the addition of an antibacterial agent to the acrylic resin is not required, so that defective molds due to the addition are eliminated, resulting in an increased yield and hence a reduced cost. Also, the antibacterial function can be readily added to any key only by adding the antibacterial agent to an adhesive generally used in the manufacture of keys.

Preferably, the key cover is made of a porous material. An artificial ivory often used generally in key covers falls under this porous material. With this construction, the antibacterial agent included in the adhesive layer volatilizes not only from the side surfaces of the key but also from the upper surface of the key cover after the antibacterial agent passes through the pores and permeates the key cover, thus making it possible to more effectively perform the antibacterial function.

Also preferably, the antibacterial agent comprises calcium phosphate containing one or more metals selected from a group including silver, copper, and zinc. According to this construction, the antibacterial activity possessed by these metals provides an effective antibacterial effect. In this case, metal silver is particularly preferable since it has been used as table services, coronas, and so on and exhibits high safety to human bodies. In addition, when calcium phosphate is used as a carrier for carrying a metal, the safety can be ensured.

DETAILED DESCRIPTION OF THE INVENTION

Figure 1:
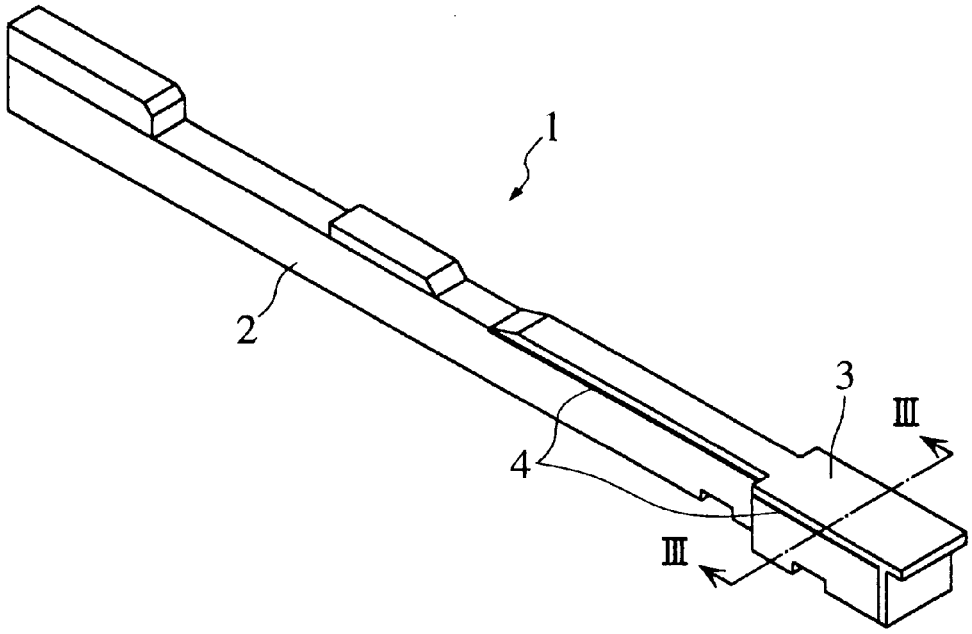
FIG. 1 is a perspective view of a key (white key) of an acoustic piano to which the present invention is applied.
Figure 2:
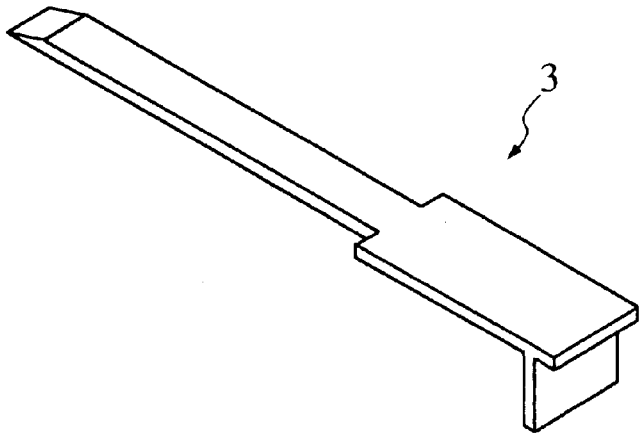
FIG. 2 is a perspective view of a key cover for the key of FIG. 1.

A preferred embodiment of the present invention will hereinafter be described in detail with reference to the drawings. FIG. 1 illustrates a key (white key) of an acoustic piano to which the present invention is applied. The key 1 comprises a key stick 2 and a key cover 3. The key stick 2 is made of a solid woody material such as spruce and has substantially a uniform rectangular cross-section. The key cover 3 is made of acrylic resin such as methyl methacrylate resin, similar to a normal key cover, and is injection molded into a shape as illustrated in FIG. 2 by an injection molding machine, not shown. Then, the key cover 3 is adhered to a front portion of the upper surface and the front surface of the key stick 2 by an adhesive layer 4, as illustrated in FIG. 1, to complete a playing area which is directly touched by a finger of a player for playing the piano.

The adhesive layer 4 is composed of an adhesive comprising, for example, aqueous vinyl urethane, and a predetermined amount of an antibacterial agent uniformly distributed in the adhesive. As the antibacterial agent, "Apacider A" (a registered trademark) (manufactured by Sangi Co.), for example, may be used. The Apacider A employs calcium phosphate (hydroxyapatite or tri-basic calcium phosphate) as a carrier which carries metallic silver, and is manufactured as a ceramic material, wherein a mixture of calcium phosphate and silver compound is sintered at high temperatures equal to or higher than 1000° C., and during this sintering process, silver ions in the silver compound are all transformed into metallic silver. The complete transformation of the silver ions into metallic silver has been confirmed from the fact that no silver ions are eluted in water by conducting an analysis according to the atomic-absorption spectroscopy (the analysis limit is 0.05 ppm).

Figure 3:
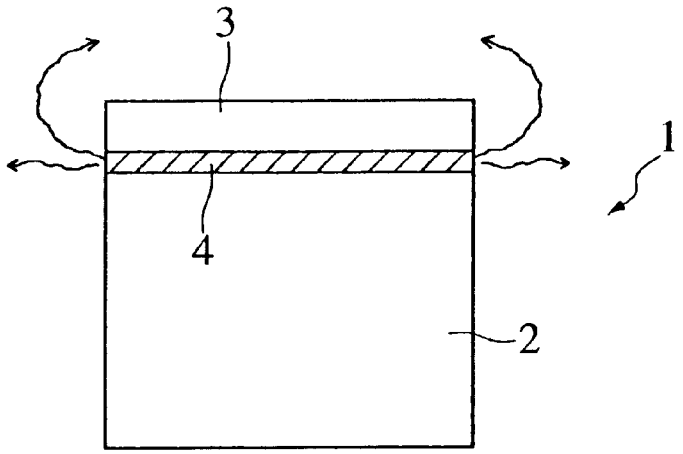
FIG. 3 is a cross-sectional view taken along a line III—III in FIG. 1.

With the key 1 constructed as described above, the adhesive layer 4 is exposed on the side surfaces between the key stick 2 and the key cover 3, as illustrated in FIG. 3, so that the antibacterial agent included in the adhesive layer 4 gradually volatilizes from the side surfaces to the outside and surrounds the key 1. As a result, the proliferation of bacteria on the key 1 is prevented by the action of the antibacterial agent, thereby making it possible to maintain the cleanliness of the key 1 as well as to prevent discoloration of the key due to the proliferation of bacteria. In addition, since the apacider A, i.e., a ceramic material made by sintering a mixture of metal silver and calcium phosphate is employed as the antibacterial agent, the components have high safety to human bodies and environment. Also, the ceramic material exhibits an excellent stability and therefore provides the antibacterial effect for a long term.

In this way, the key 1 of this embodiment can be readily provided with the additional antibacterial function only by adding the antibacterial agent to an adhesive which is generally used for the manufacture. For this reason, the key cover 3 itself need not have the antibacterial nature so that it can be manufactured by a injection molding technique similar to generally used ones, thus resulting in an increased yield and consequently a reduced cost.

Figure 4:
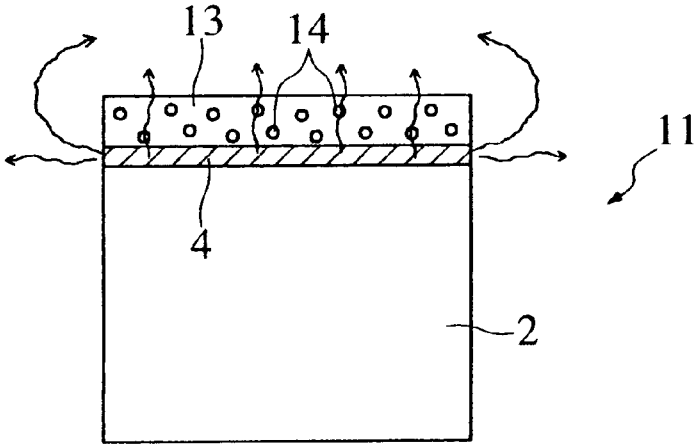
FIG. 4 is a cross-sectional view, similar to FIG. 3, of a key according to a second embodiment of the present invention.

FIG. 4 illustrates a key 11 according to a second embodiment of the present invention. The key 11 differs from the foregoing first embodiment only in that a key cover 13 is made of porous artificial ivory. The key cover 13 may be manufactured, for example, in the following way.

Cellulose acetate flake is applied with:

27 wt % of phthalate plasticizer;

0.2 wt % of epoxy compound and 0.3 weight percent of alkyl phosphate as a thermal stabilizer;

30 wt % of silica with a silanol base of 2.1 per 100 square angstrom, a BET ratio surface area of 136 $m^2/g$, and an average grain diameter of 0.9 $\mu$m as silica; and 2.5 wt % of white pigment, stirred for four hours at 80° C. using a universal stirrer for mixing them, and simultaneously dried until a water content is reduced to 0.2 wt % or less.

Next, the mixture is melted and kneaded at 220° C., and extruded using an extruder having a diameter of 40 mm so that the mixture is transformed into pellets.

Finally, the key cover 13 is molded by an injection molding machine using the pellets.

The key cover 13 molded in the foregoing way includes a large number of pores internally formed as illustrated in FIG. 4. Thus , the key 11 of this embodiment can more effectively perform an antibacterial function since the antibacterial agent included in the adhesive layer 4 volatilizes not only from the side surfaces of the key 11 but also from the upper surface of the key cover 13 after the antibacterial agent permeates the key cover 13 through the large number of pores 14. In addition, since the key cover is made of cellulose derivative resin containing particular silica, the key 11 advantageously provides a better hygroscopic property, a comfortable touch feeling with a finger, a firm structure, a good workability, and so on.

The present invention can be implemented in a variety of forms without limited to the embodiments described above. For example, while the described embodiments have shown examples in which the present invention is applied to a white key of an acoustic piano, the present invention can of course be applied to black keys as well as to other musical instruments having a keyboard such as organs, electronic pianos, and so on. Also, the kind of antibacterial agent is not limited to the illustrated Apacider A, i.e., a ceramic material formed of a mixture of sintered metal silver and calcium phosphorate, but may be any agent including another metal having the antibacterial activity such as copper, zinc, or the like, or including any other material than calcium phosphorate as a carrier. Further, it is not essential that the antibacterial agent has the form of a ceramic material. In addition, details in construction can be modified as required without departing from the gist of the present invention.

What is claimed is:

1. An antibacterial key having sides and a top, said key comprising:

a key stick; and a key cover adhered to only an upper surface of said key stick by an adhesive layer, said adhesive layer having a volatilizing antibacterial agent therein, wherein said antibacterial agent volatilizes from side surfaces of said adhesive layer and surrounds the sides and top of the key to provide an antibacterial effect.

2. The key of claim 1, wherein the key cover is made of a porous material and said antibacterial agent further passes through the porous material of the key cover and volatilizes from an upper surface of the key cover.

3. The key of claim 1, wherein the antibacterial agent comprises calcium phosphate and at least one metal selected from the group consisting of silver, copper and zinc.

4. The key of claim 2, wherein the antibacterial agent comprises calcium phosphate and at least one metal selected from the group consisting of silver, copper and zinc.

5. The key of claim 3, wherein the at least one metal is silver.

6. The key of claim 4, wherein the at least one metal is silver.

7. A key cover having a top and a bottom adapted to be positioned on a key stick, only said bottom of the key cover being adhered to said key stick by an adhesive having a volatilizing antibacterial agent therein to form a key having sides and a top, wherein said antibacterial agent volatilizes from side surfaces of said adhesive layer and surrounds the sides and top of the key to provide an antibacterial effect.

8. The key cover of claim 7, wherein the key cover is made of a porous material and said antibacterial agent further passes through the porous material of the key cover and volatilizes from an upper surface of the key cover.

9. The key cover of claim 7, wherein the antibacterial agent comprises calcium phosphate and at least one metal selected from the group consisting of silver, copper and zinc.

10. The key cover of claim 8, wherein the antibacterial agent comprises calcium phosphate and at least one metal selected from the group consisting of silver, copper and zinc.

11. The key cover of claim 9, wherein the at least one metal is silver.

12. The key cover of claim 10, wherein the at least one metal is silver.

13. A method of providing an antibacterial effect to sides and a top of a key which comprises a key cover and key stick, comprising:

incorporating a volatile antibacterial agent into an adhesive layer; and adhering the key cover to the key stick with the adhesive layer, wherein the adhesive laver is applied only between an upper surface of the key stick and a bottom surface of the key stick, whereby the antibacterial agent volatilizes from side surfaces of said adhesive layer, thereby providing said sides and top of the key with an antibacterial effect.

14. The method of claim 13, wherein the key cover is made of a porous material and said antibacterial agent further passes through the porous material of the key cover and volatilizes from an upper surface of the key cover.

15. The method of claim 13, wherein the antibacterial agent comprises calcium phosphate and at least one metal selected from the group consisting of silver, copper and zinc.

16. The method of claim 14, wherein the antibacterial agent comprises calcium phosphate and at least one metal selected from the group consisting of silver, copper and zinc.

17. The method of claim 15, wherein the at least one metal is silver.

18. The method of claim 16, wherein the at least one metal is silver.

* * * * *